US007841748B2

(12) United States Patent
Rodstein et al.

(10) Patent No.: US 7,841,748 B2
(45) Date of Patent: Nov. 30, 2010

(54) DIFFRACTOR-DIFFUSER SYSTEM FOR A FLUORESCENT LUMEN PACKAGE

(75) Inventors: David D. Rodstein, Haverford, PA (US); Stewart B. Lewis, Dunwoody, GA (US)

(73) Assignee: RLR Industries, Inc., Mableton, GA (US)

( * ) Notice: Subject to any disclaimer, the term of this patent is extended or adjusted under 35 U.S.C. 154(b) by 380 days.

(21) Appl. No.: 11/755,947

(22) Filed: May 31, 2007

(65) Prior Publication Data

US 2008/0130280 A1 Jun. 5, 2008

Related U.S. Application Data

(60) Provisional application No. 60/803,567, filed on May 31, 2006, provisional application No. 60/828,742, filed on Oct. 9, 2006.

(51) Int. Cl.
*F21V 7/06* (2006.01)
*F21V 5/02* (2006.01)
*F21V 7/22* (2006.01)

(52) U.S. Cl. ..... 362/307; 362/260; 362/297; 362/347; 362/350

(58) Field of Classification Search ..... 362/260, 362/297, 304, 307, 346, 347, 350, 361
See application file for complete search history.

(56) References Cited

U.S. PATENT DOCUMENTS 4,218,727 A * 8/1980 Shemitz et al. ..... 362/297
4,262,326 A * 4/1981 Lewin ..... 362/223
4,839,781 A * 6/1989 Barnes et al. ..... 362/299
5,197,798 A 3/1993 Tickner
5,348,359 A 9/1994 Boozer
5,355,290 A * 10/1994 Tickner ..... 362/294
5,363,295 A 11/1994 DeKleine et al.
5,377,086 A * 12/1994 Tickner ..... 362/235
5,444,606 A * 8/1995 Barnes et al. ..... 362/340
5,473,522 A 12/1995 Kriz et al.
D367,337 S 2/1996 Barnes et al.
5,523,931 A * 6/1996 Kassay et al. ..... 362/235
D386,267 S 11/1997 Tickner
5,704,674 A 1/1998 Boozer
5,720,548 A 2/1998 Geary
5,809,850 A 9/1998 Tickner
5,823,073 A 10/1998 Tickner
RE36,414 E 11/1999 Tickner
D431,316 S 9/2000 Tickner
6,447,147 B1 * 9/2002 Kramer et al. ..... 362/297

(Continued)

OTHER PUBLICATIONS

Lexalite International Corporation, 800 Series Prismatic Reflexors—Model 822, 2003, web page print out.*

(Continued)

*Primary Examiner*—Ismael Negron
(74) *Attorney, Agent, or Firm*—Gardner Groff Greenwald & Villanueva, PC

(57) ABSTRACT

The diffractor has a profile defined by first, second and third parabolic segments, and continuously tapering facets for improved lighting performance. Different diffuser geometries are provided to generate differing light distribution patterns, including a conical diffuser, and a diffuser having a fresnel lens portion and an angled flange portion. Equal numbers of facets and/or facets of similar geometrical profile may be provided on the diffuser and on the diffractor.

53 Claims, 9 Drawing Sheets

U.S. PATENT DOCUMENTS

| | | | | |
|---|---|---|---|---|
| 6,550,938 | B2 | 4/2003 | Barnes, II et al. | |
| 6,575,601 | B1 * | 6/2003 | Sitzema et al. | 362/340 |
| 6,698,908 | B2 | 3/2004 | Sitzema, Jr. et al. | |
| D494,308 | S | 8/2004 | Sales | |
| 6,905,226 | B2 | 6/2005 | Tickner et al. | |
| 6,910,785 | B2 | 6/2005 | Sales | |
| 7,025,476 | B2 * | 4/2006 | Leadford | 362/309 |
| 7,513,646 | B2 * | 4/2009 | Catone et al. | 362/216 |
| 2004/0141324 | A1 * | 7/2004 | Sales | 362/333 |

OTHER PUBLICATIONS

Lexalite International Corporation, Models 622 and 630-22" and 30" Diameter Multiple Use Drop Lenses (Data Sheet), 2003.*

Lexalite International Corporation, Models 350, 351, 360 and 361—16 inch Diameter Drop Lenses (Data Sheet), 2003.*

Lexalite International Corporation, Conical Drop Lens—Model 22CDL (Data Sheet), 2005.*

* cited by examiner

DIFFRACTOR-DIFFUSER SYSTEM FOR A FLUORESCENT LUMEN PACKAGE

CROSS-REFERENCE TO RELATED APPLICATION

This application claims the priority benefit of U.S. Provisional Patent Application Ser. No. 60/803,567, filed May 31, 2006 and Application Ser. No. 60/828,742, filed Oct. 9, 2006, which applications are incorporated herein by reference in their entireties.

TECHNICAL FIELD

The present invention relates generally to the field of lighting, and more particularly to a light fixture having a diffractor-diffuser lumenaire system optimized for use in connection with a spaced multi-lamp high-efficiency fluorescent lumen package.

BACKGROUND OF THE INVENTION

Lighting fixtures commonly incorporate a lumenaire for distributing light from the bulb or bulbs housed within the fixture. The luminaires for industrial fixtures are typically configured for distributing light from a single high-intensity discharge light bulb positioned generally centrally within the fixture. For example, the prismatic light-distributing surfaces of these luminaires may be structured and oriented to diffract and diffuse light emanating from a centrally-positioned point source of light into an even lighting pattern.

High-efficiency fluorescent bulbs have been developed, which consume considerably less energy than high-intensity discharge light bulbs generating equivalent light output. Typically, however, two or more such fluorescent bulbs are used in combination in a lumen package to produce the desired light output. The individual bulbs within a lumen package are typically spaced a distance from one another such that some or all of the bulbs are located a distance away from the center of the fixture. As a result, luminaires that are configured for distribution of light from a central point source are often ineffective and inefficient for diffusion and distribution of light from a lumen package of high-efficiency fluorescent bulbs, often generating significant glare and/or an uneven distribution of light.

Accordingly, it can be seen that needs exist for a diffractor-diffuser system optimized for use in connection with a high-efficiency fluorescent lumen package within a light fixture. It is to the provision of a system meeting these and other needs that the present invention is primarily directed.

SUMMARY OF THE INVENTION

The present invention provides a light fixture and a diffractor-diffuser system optimized for use in connection with a high-efficiency fluorescent lumen package within a light fixture. In example forms, the system of the present invention generates an evenly distributed light pattern, without significant glare, from a spaced array of light sources wherein one or more of the light sources is/are positioned a distance away from the center of the fixture.

In one aspect, the invention is a lighting diffractor comprising a light-transmissive shell having an inner surface and an outer surface. The shell preferably has a cross-sectional profile including a first parabolic segment positioned toward a top portion of the diffractor, a second parabolic segment positioned at an intermediate portion of the diffractor, and a third parabolic segment positioned toward a lower rim portion of the diffractor.

In another aspect, the invention is a lighting diffractor, preferably including a shell having a number of continuously tapered facets arranged thereon. Each of the continuously tapered facets preferably tapers progressively wider from an upper end adjacent a top portion of the diffractor to a lower end adjacent a lower rim portion of the diffractor.

In another aspect, the invention is a light fixture including a diffractor having a number of facets arranged thereon, each of said facets extending from an upper end toward a top portion of the diffractor to a lower end toward a lower rim of the diffractor. The fixture preferably also includes a diffuser for attachment to the lower rim of the diffractor. The diffuser preferably includes a number of longitudinal facets equal to the number of facets on the diffractor.

In still another aspect, the invention is a lumenaire system including a diffractor compatible with a plurality of diffuser configurations. The lumenaire system is preferably optimized for light distribution and efficiency when used in connection with a multi-lamp lumen package comprising a plurality of lamps, each of those lamps being located at a distance from a central axis of the diffractor.

These and other aspects, features and advantages of the present invention will be understood by those of skill in the art in view of the example embodiments described and shown.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
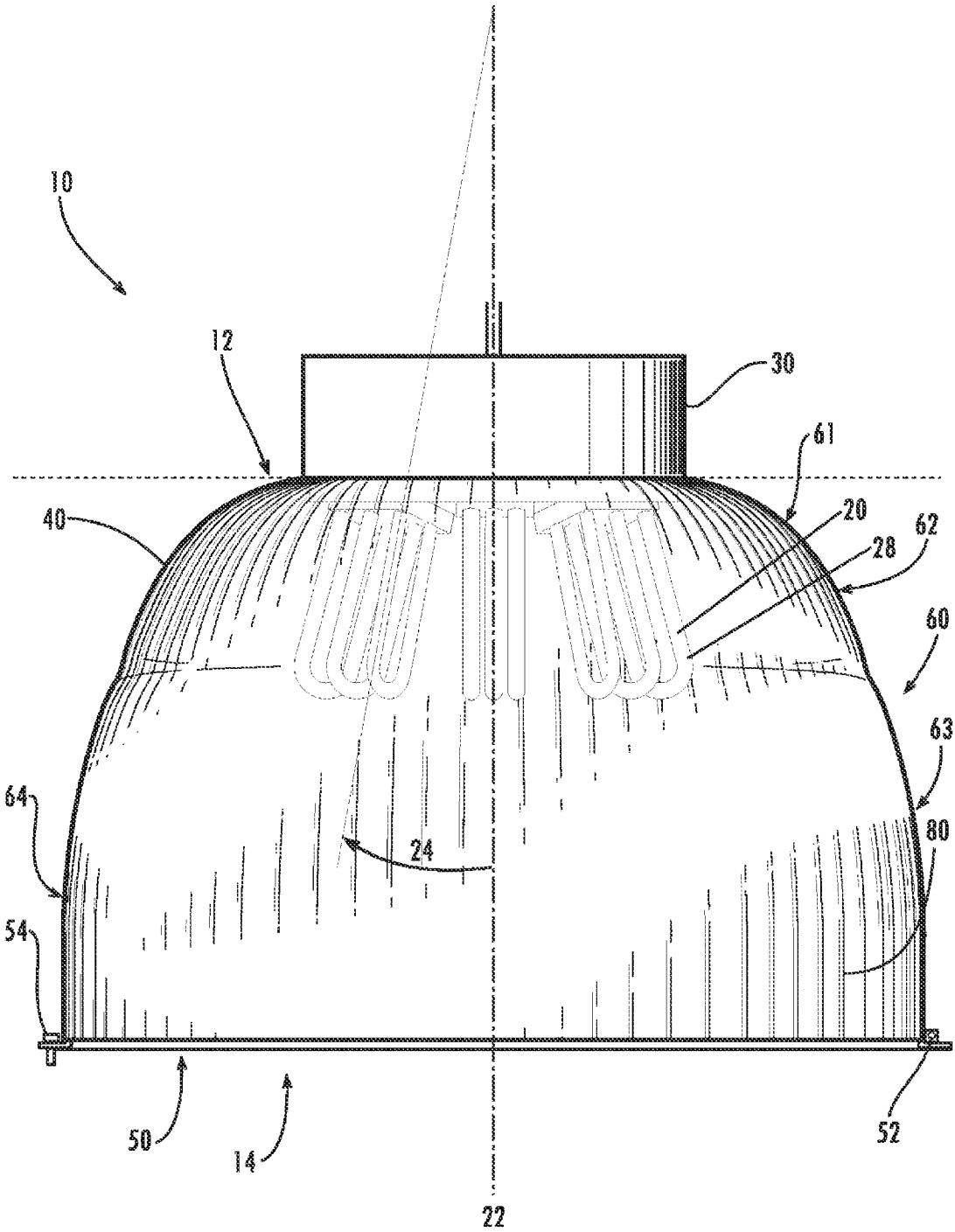
FIG. 1 shows a side view of a lumenaire including a diffractor according to one example embodiment of the present invention.

Referring now to the drawing figures, FIGS. 1-4 show a wide distribution light fixture 10 according to a first exemplary embodiment of the present invention. FIG. 1 depicts the light fixture 10 comprising at least one illumination source 20, a housing 30, a diffractor 40, and a protective lens 50. Generally, the light fixture 10 has a top side 12 and a bottom side 14. The light fixture 10 is suitable for use with, but not limited to, high-bay, low-bay, industrial, and non-industrial applications.

Figure 3:
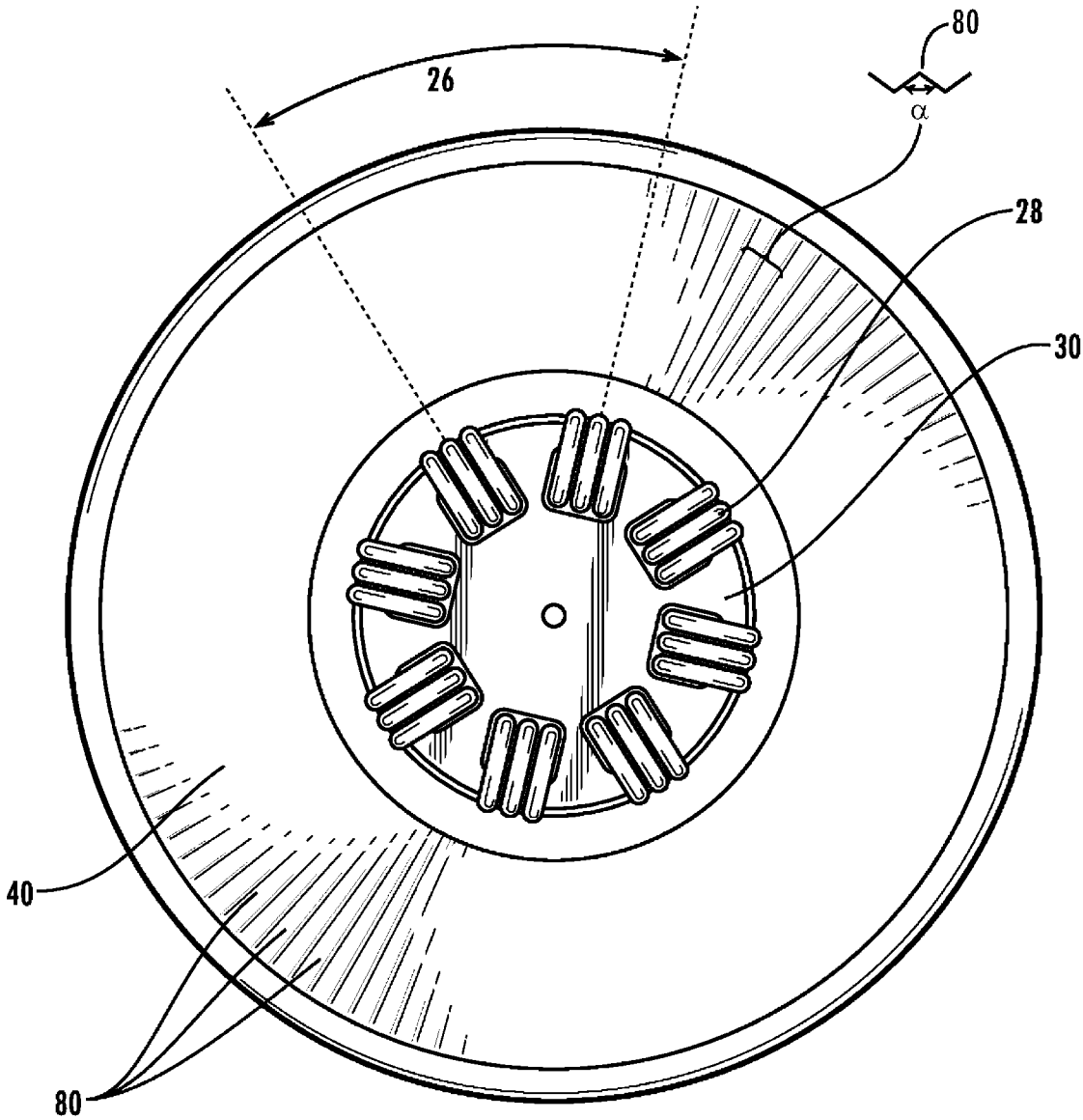
FIG. 3 shows a bottom plan view of the light fixture of FIG. 1.

As depicted in FIG. 1, the light fixture 10 contains at least one illumination source 20. While the illumination source 20 can consist of a single lamp or bulb 28, it is preferable that the illumination source comprises an array of two or more lamps, which combine as a lumen package, to enhance the illumination properties of the fixture 10. The lumen package is preferably centered generally about a central vertical axis 22 of the light fixture 10, with each lamp located at a radial distance from the central axis. The lamps 28 are optionally inclined relative to the central vertical axis 22 at an inclination angle 24 as depicted in FIG. 1. The inclination angle 24 at which optical efficiency and heat diffusion are optimized ranges between zero and 60 degrees, depending on factors including the size and shape of the diffractor 40 and the number of lamps 28 present within the fixture 10. In example embodiments, the lamps 28 are vertically oriented such that angle 24 is zero. Additionally, the number of lamps 28 used within each fixture 10 varies with the size of the fixture and the application desired by a user. For example, an 18 inch diameter fixture 10 may use eight 42 watt lamps, or four 70 watt lamps; and a 25 inch diameter fixture may use nine 36 watt lamps, five 70 watt lamps, or four 120 watt lamps. The lamps 28 are preferably equally spaced from one another, as seen in FIG. 3, by a circumferential angle of separation 26. The angle of separation 26 is defined by the following formula:

360 degrees/Number of Lamps=Reference Angle 26.

Various types of lamps 28 can be used in conjunction with the present invention including, but not limited to, high-pressure sodium, metal halide, mercury vapor and other commercially available lamps. However, it is preferable that the illumination source 20 comprise one or more high efficiency lamps such as fluorescent, light emitting diode (LED), or other types of high efficiency lamps.

Figure 2:
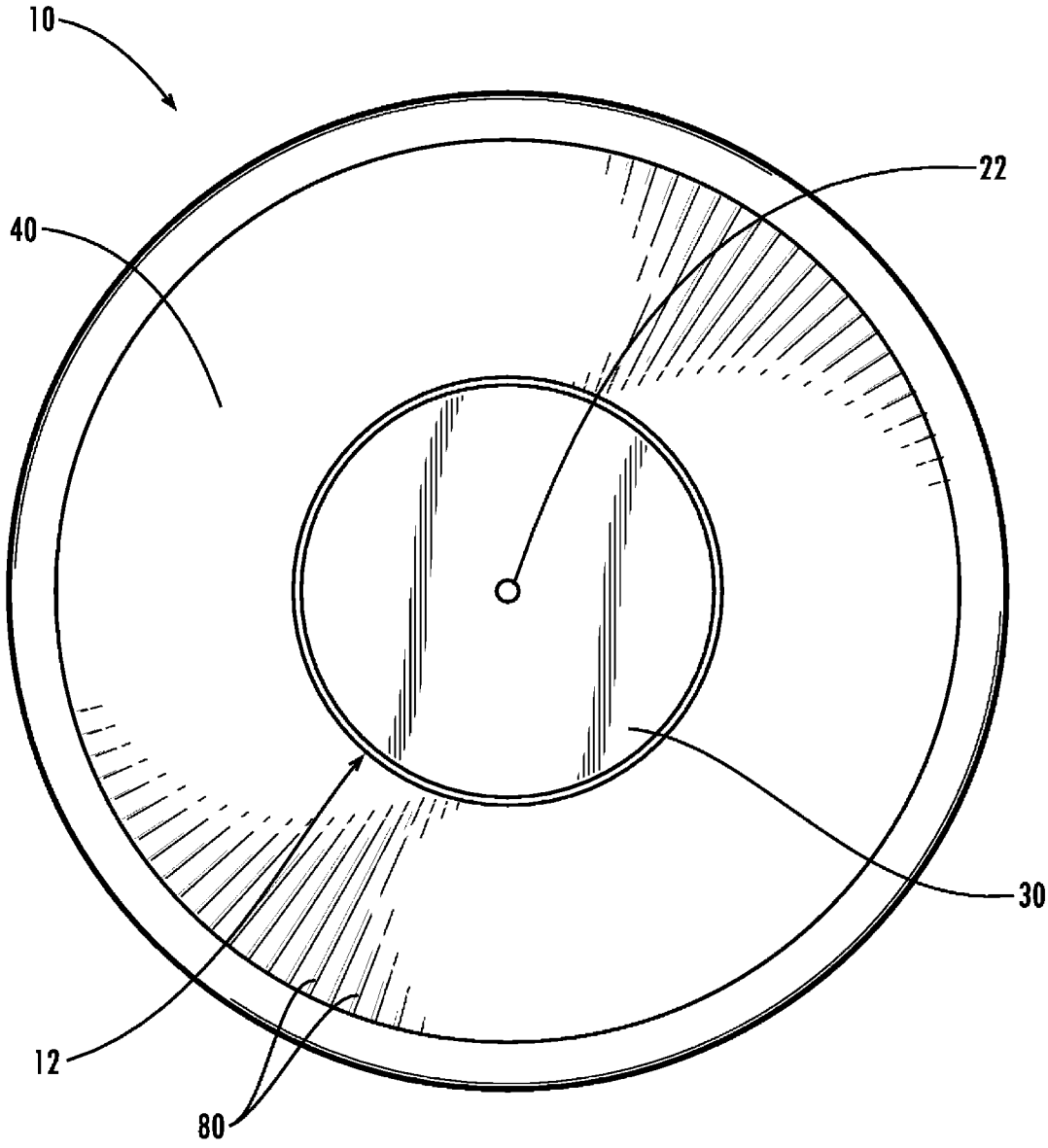
FIG. 2 shows a top plan view of the light fixture of FIG. 1.

As depicted in FIG. 2, a lamp housing 30 is preferably centrally disposed along the central vertical axis 22 and can generally be affixed by conventional means to the top surface 12 of the lumenaire. The housing 30 preferably comprises one or more electrical couplings for delivering power to the lamps 28. These couplings preferably comprise at least one electrical socket 32 (not shown) per lamp. It will be understood that the present invention is intended to include various types of electrical sockets 32 for use with any form of commercially known lamps 28.

The diffractor 40 of the present invention is preferably formed as a unitary body comprised of transparent or translucent material. In example embodiments, the diffractor 40 is formed of plastic, acrylic, or glass material, for example a 1.5 refractive index clear acrylic material. However, in other embodiments, various other materials of construction are used including opaque materials and/or reflective materials such as aluminum or brass having internal reflective surfaces.

Figure 4:
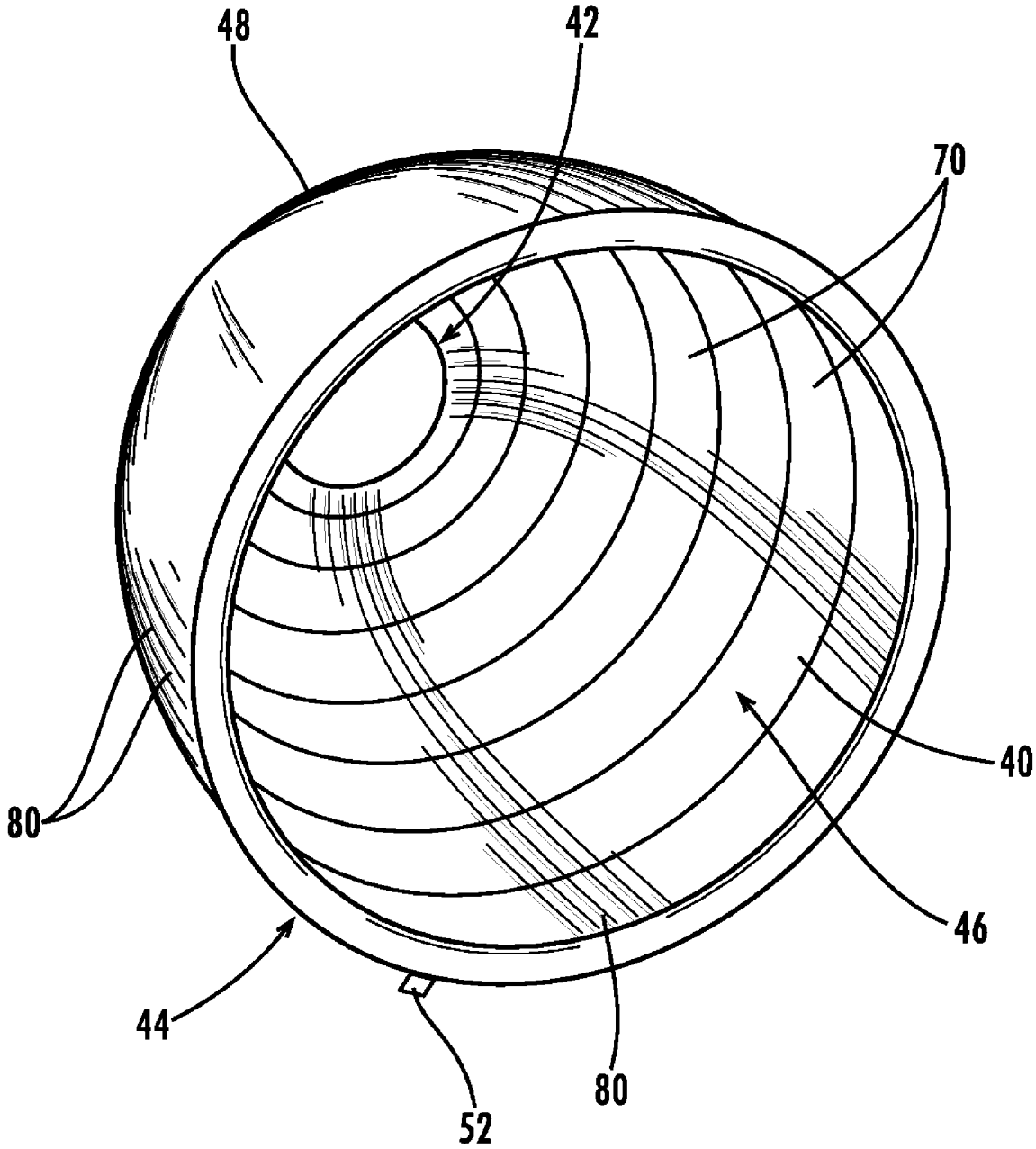
FIG. 4 shows a perspective view of the diffractor of FIG. 1.

FIG. 4 depicts a translucent diffractor 40 according to an example embodiment of the present invention where the housing 30 and the illumination source 20 have been removed for simplification. The diffractor 40 is defined by an upper rim 42, lower rim 44, interior surface 46, and exterior surface 48. The upper rim 42 is preferably adapted to secure the housing 28 to the diffractor 40 using conventional means. In example embodiments, the upper rim 42 may have a diameter ranging from four inches to twelve inches and in other embodiments the diameter may vary depending on the size of the light fixture 10 and/or the desired application of a user. The lower rim 44 is optionally fitted to receive a protective lens 50, as seen in FIG. 1, to cover the bottom of the diffractor 40. Optionally, the lens 50 connects to the lower rim 44 with a two-piece hinge 52, and may be secured in place with a captive connector such as a latch and pin fastener 54. Additionally, the pin fastener 54 may be secured to the fixture to prevent loss during assembly and service. In still further embodiments, the lens 50 is affixed to the diffractor 40 with clips, wing nuts, bands, or other suitable attachment means. In other embodiments, the diffractor 40 is not equipped with such a lens 50.

The diffractor 40 generally takes the form of an inverted bowl having a hollow interior. In specific embodiments, the diffractor 40 is a hollow shell having a cross-sectional geometry determined by a stepped parabolic profile 60, as shown in FIG. 1, defined by first, second and third parabolic segments which are designated by reference numbers 61, 62, and 63. Mathematically speaking, the stepped parabolic profile 60 forms a three-dimensional paraboloid 64 when revolved about the central vertical axis 22. The resulting paraboloid 64 provides for a wider top side 12 than previously known in the art, allowing the diffractor 40 to accommodate a multi-lumen array of bulbs spaced circumferentially from one another, and displaced a distance from the central axis of the housing. This profile also reflects and distributes a greater percentage of light out of the lamp fixture 10 than previously known fixtures when used with a spaced multi-lumen array of bulbs. Additionally, relative to light fixtures known in the art, the paraboloid 64 of the present invention effectively reduces the amount of glare caused by light reflecting on the inside surface of the light fixture 10. Furthermore, this geometry is optimized for distribution of light from high efficiency bulbs such as a spaced multi-lamp lumen package of two or more fluorescent and/or LED lamps. In alternative embodiments, the diffractor 40 geometry is defined by revolving a single parabolic profile, a multi-parabolic profile, an elliptical profile, and/or a hyperbolic profile around the central vertical axis 22.

As best illustrated in FIG. 4, the interior surface 46 of the diffractor 40 is formed to define a plurality of prisms 70. In example embodiments, the prisms 70 are oriented in a substantially horizontal position or various other orientations depending on the particular lighting application. For example, the prisms 70 may be positioned in a vertical orientation, they may crisscross, overlap, or the prisms may be oriented at different angles within the diffractor 40 such that the prisms are neither horizontal nor vertical.

In the depicted embodiment, a plurality of longitudinal facets 80 line the interior and/or exterior surface 46, 48 of the diffractor 40 as shown in FIG. 2. In example embodiments, the facets 80 are generally positioned to follow the profile 60 of the diffractor 40 and are preferably oriented in a substantially vertical fashion. However, in alternative embodiments, the facets 80 are curved or angled depending on the application desired by the user. As best illustrated in FIGS. 1 & 2, the facets 80 are preferably configured as V-shaped (in profile) angular ribs and/or grooves, which are equally spaced about the outer circumference of the diffractor 40. In alternative embodiments, the cross-sectional profile of the facets 80 may take any of a variety of shapes including, but not limited to, U-shaped or channel-shaped ribs and/or grooves.

The facets 80 preferably cover substantially the entire circumference of the exterior surface 48 or may be clustered in particular areas about the circumference depending on the particular lighting application. In preferred embodiments, the facets 80 extend from the lower rim 44 to the upper rim 42 and circumscribe the diffractor 40. As the facets 80 extend from the lower rim 44 to the upper rim 42, it is preferable that the angle of each facet tapers, and therefore the width of each facet narrows. The included angle ($\alpha$) of the facets' V-shape may vary depending on factors including the number of facets and the thickness of the diffuser material, but in example embodiments the included angle of the facets tapers from about 70° to 90°, most preferably about 81° at the bottom rim of the diffractor; to about 30° to 55°, most preferably about 43° at the top of the diffractor. These facet geometries have been found to contribute to superior light distribution and reflective properties when used in connection with spaced multi-lumen arrays of high-efficiency lamps. The continuously tapering facet geometry of the present invention has been found to provide greatly reduced glare relative to light fixtures currently known in the art having facets of constant width alternating with facets that extend along only a portion of the diffractor's height, especially when used with lumen packages comprising multiple fluorescent or LED lamps. In example embodiments, the number of facets 80 encircling the refractor 40 is about 130-230, and more preferably about 180, with approximately one facet per two degrees of circumference.

Figure 5:
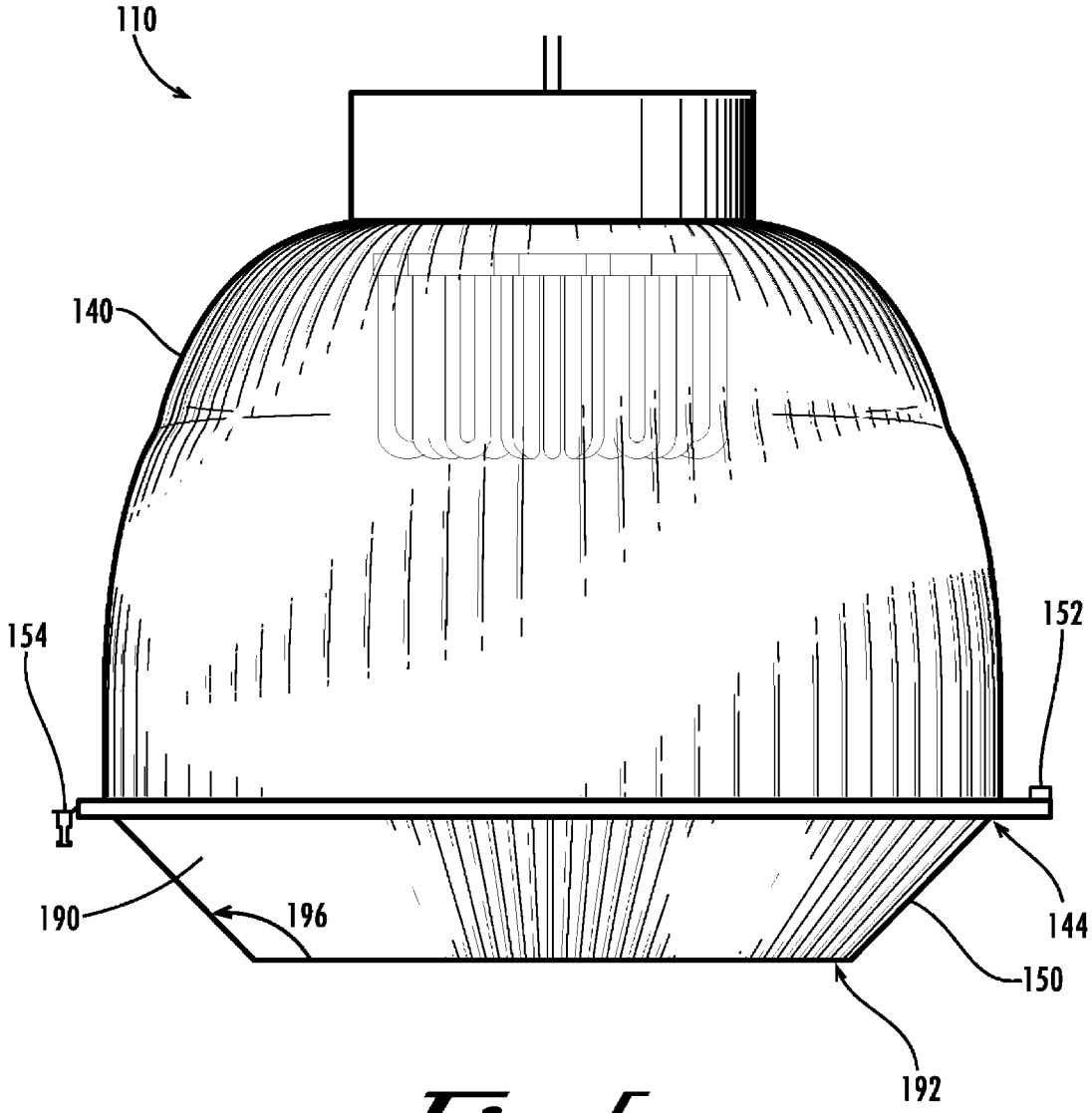
FIG. 5 shows a side view of a light fixture including a housing, diffractor and diffuser according to a second example embodiment of the present invention.
Figure 6:
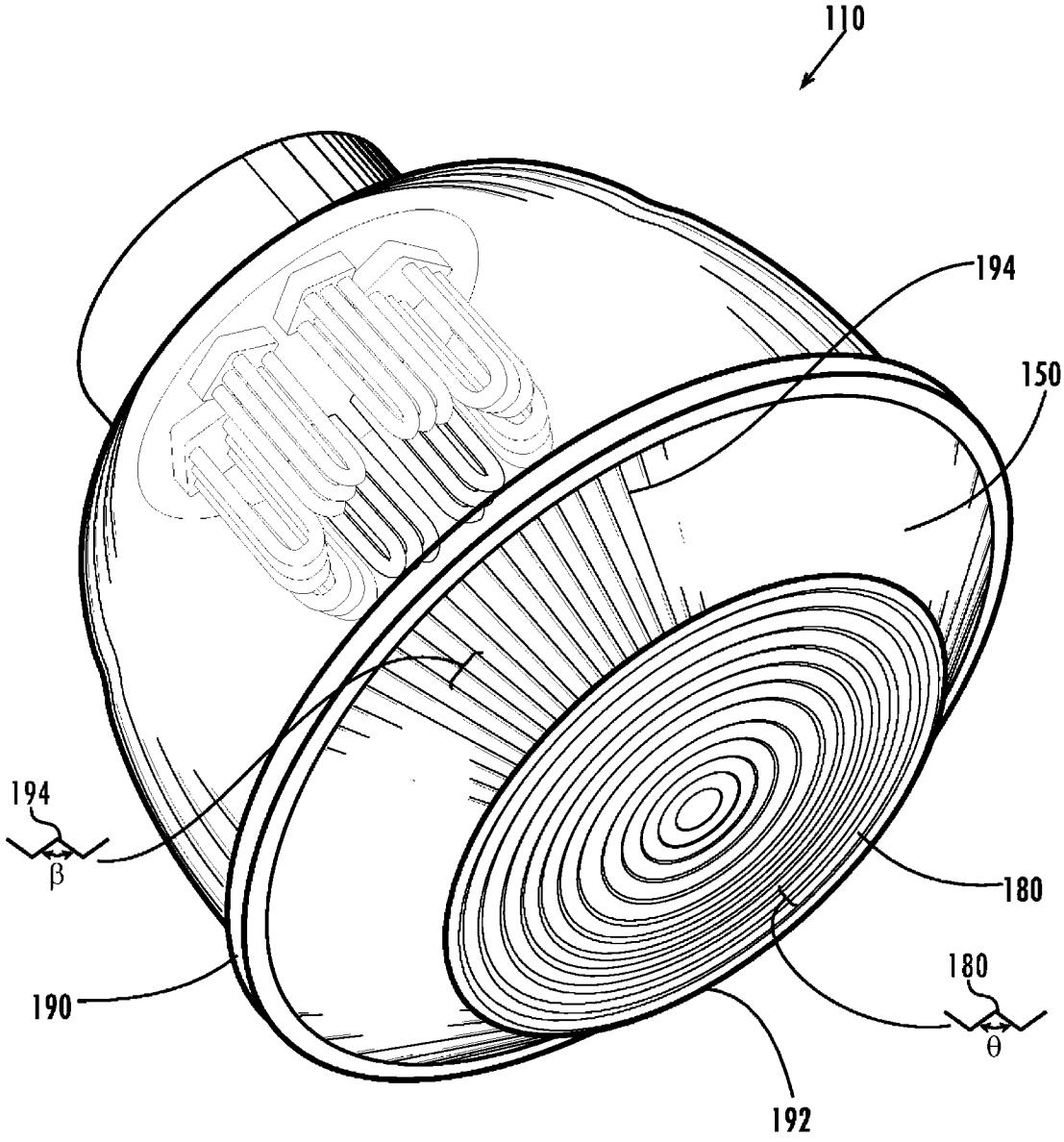
FIG. 6 shows a perspective view of the light fixture of FIG. 5.
Figure 7:
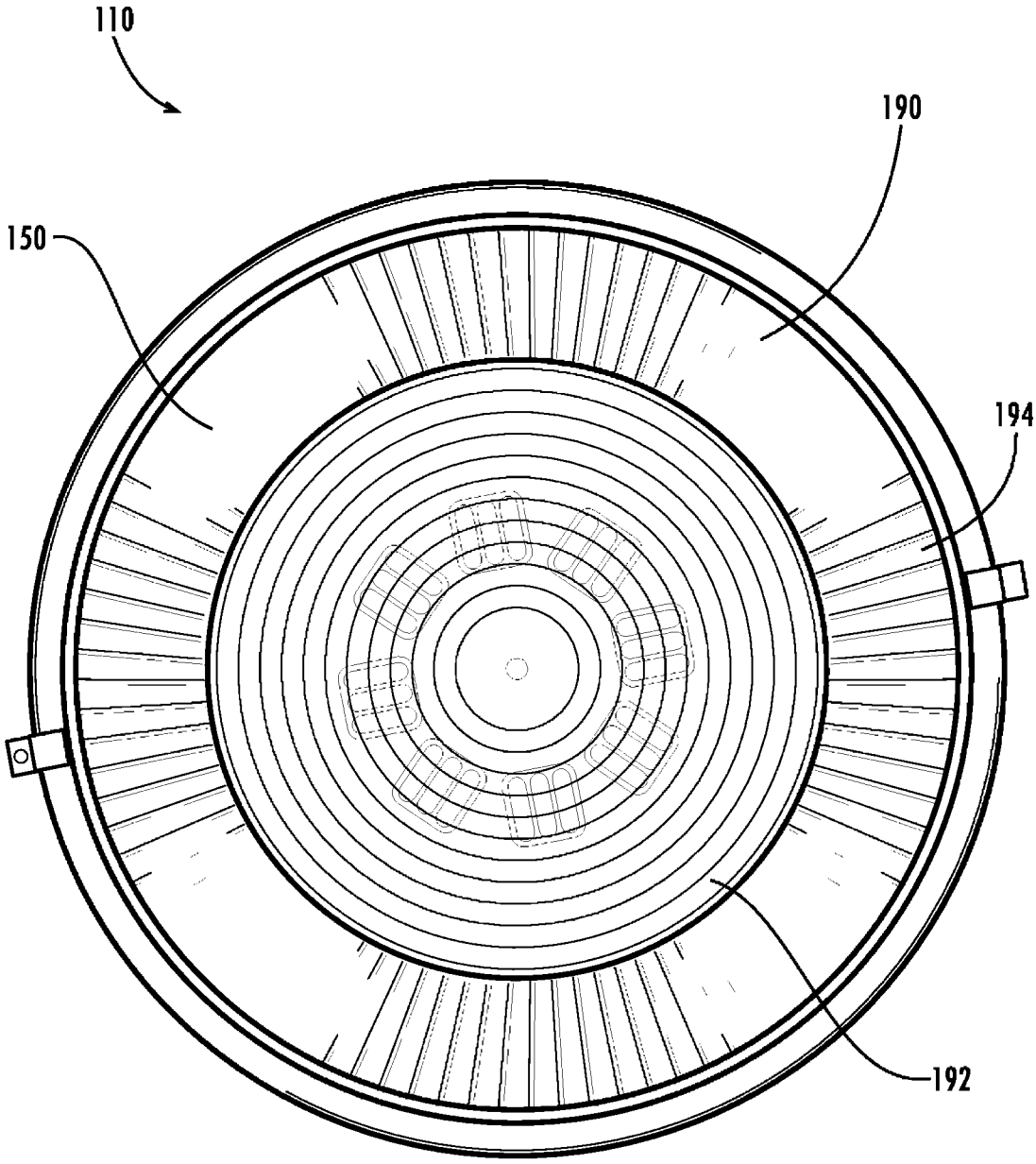
FIG. 7 shows a bottom plan view of the light fixture of FIG. 5.

Referring now to FIGS. 5-7, there is shown a light fixture 110 according to another example embodiment of the present invention. In this embodiment, the diffractor 140 is substantially similar to that described above, and the fixture further comprises a "pie-pan" shaped diffuser 150 affixed to the lower rim 144 of the diffractor to more tightly focus the light leaving the fixture 110. The diffuser 150 is preferably a unitary body comprised of an obliquely angled side flange portion 190, and a substantially flat fresnel lens portion 192 as seen in FIGS. 5 & 6. However, in alternative embodiments, the fresnel lens 192 and the flange 190 may comprise separate pieces attached together. The angle 196 between the flange 190 and the fresnel lens 192 is preferably between 100° and 160°, more preferably between about 119° and 149°, and most preferably about 134°. The combination of the fresnel lens 192 and the angled flange 190 optimizes the focal pattern of the light output from the fixture 110, and the angular geometry of the flange has been found to contribute to superior light distribution and anti-glare properties. The diffuser 150 is preferably made from a translucent or transparent material such as glass, acrylic, or plastic, for example a 1.5 refractive index clear acrylic material. In alternate embodiments, portions of the diffuser 150 are made from opaque or reflective materials.

The outer surface of the fresnel lens portion 192 preferably comprises a plurality of concentric circular prismatic facets 180. In preferred embodiments, the concentric facets 180 are configured as V-shaped prisms. In alternative embodiments, the facets 180 take any of a variety of shapes including, but not limited to, U-shaped or channel-shaped ribs and/or grooves. The included angle ($\theta$) of the facets' V-shape may vary depending on factors including the number of facets and the thickness of the diffuser material, but preferably is between about 90° to 150°, and most preferably about 127°. The outer surface of the angled flange portion 190 preferably comprises a plurality of longitudinal facets 194, as best seen in FIGS. 6 & 7. In preferred embodiments, the flange 190 has an equal number of facets 194 (preferably about 130-230, and more preferably about 180 with approximately one facet per two degrees of circumference) as the diffractor 140, and each longitudinal facet 194 of the diffuser 150 aligns with a corresponding facet of the diffractor 140. The longitudinal facets 194 are preferably V-shaped in cross-sectional profile, but in alternate forms can be U-shaped or channel-shaped ribs and/or grooves. The included angle ($\beta$) of the longitudinal facets 194 may vary depending on factors including the number of facets and the thickness of the diffuser material, but preferably is between about 70° to 90°, and most preferably about 81°. The angular geometry of the facets of the diffuser 150 and the alignment of the facets of the diffuser with the facets of the diffractor 140 have been found to contribute to superior light distribution and reflective properties when used with multi-lamp lumen packages using high-efficiency lamps, as compared to known lighting fixtures.

Figure 8:
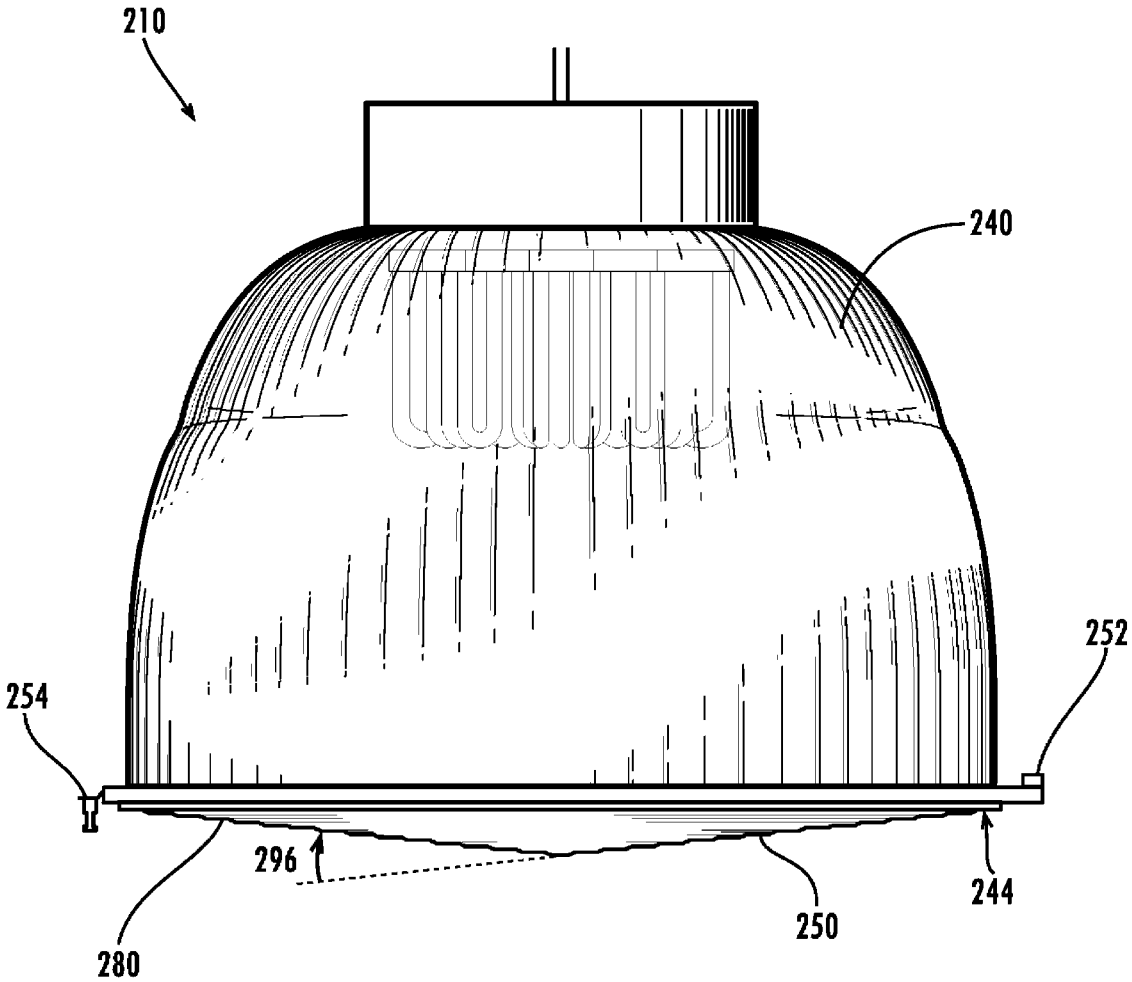
FIG. 8 shows a side view of a light fixture including a housing, diffractor and diffuser according to a third example embodiment of the present invention.
Figure 9:
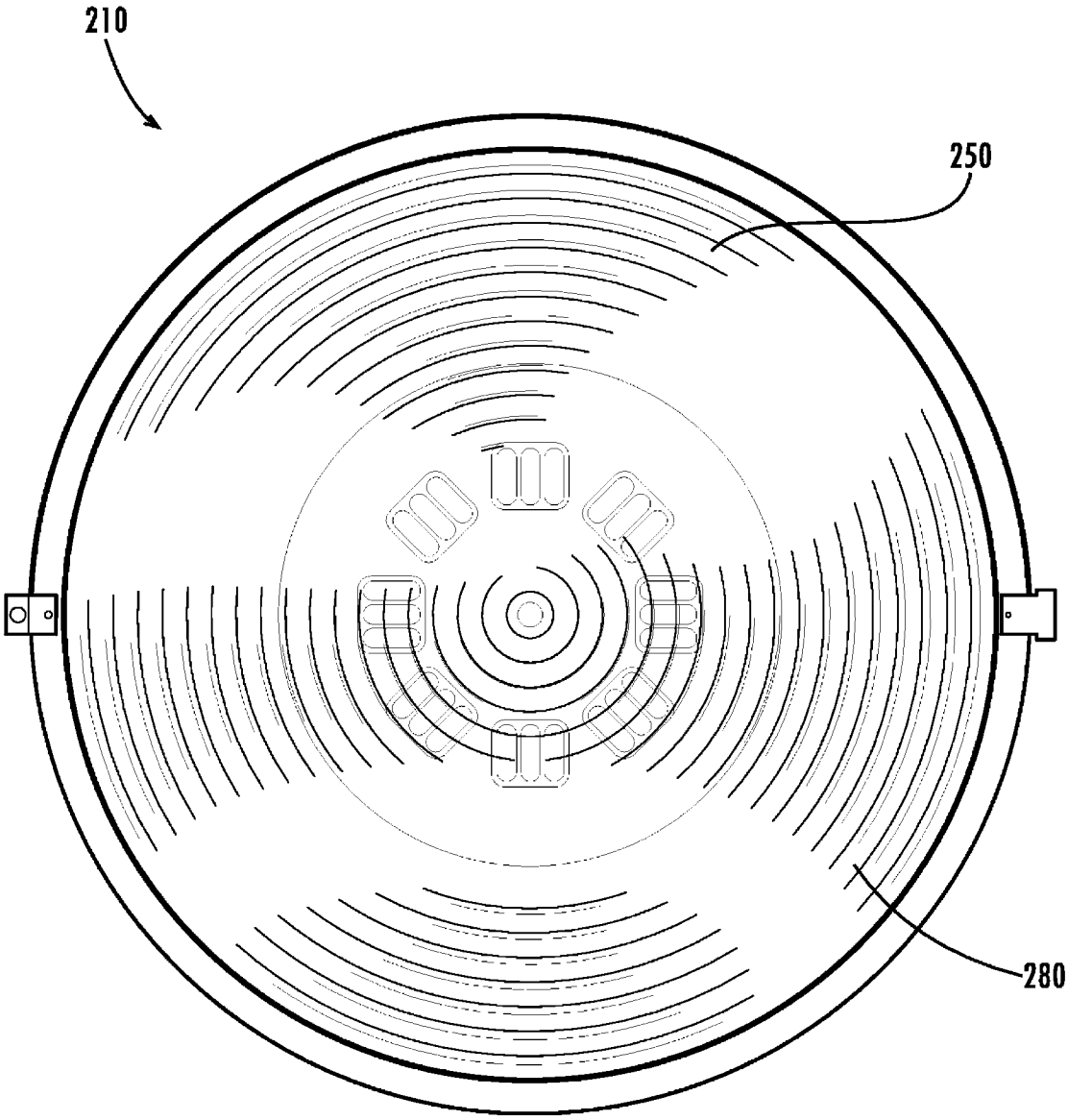
FIG. 9 shows a bottom plan view of the light fixture of FIG. 8.

FIGS. 8-9 show another example embodiment of a lumenaire 210 according to the present invention. In this embodiment, the diffractor 240 is substantially similar to that described above, and the fixture further comprises a cone shaped diffuser 250 affixed to the lower rim 244 of the diffractor to concentrate light leaving the fixture 210 in an intermediate distribution pattern between the widely dispersed first embodiment, and the tightly focused second embodiment described above. The diffuser 250 is preferably a unitary body defining a cone as seen best in the side view FIG. 8. In preferred form, the angle of inclination 296 of the cone is about 6° relative to the plane of the lower rim of the diffractor, but in alternate embodiments ranges between 3° to 20°. The diffuser 250 is preferably made from a translucent or transparent material such as glass, acrylic, or plastic, for example a 1.5 refractive index clear acrylic material. In alternate embodiments, portions of the diffuser 250 may be made from opaque or reflective materials as so desired by the user. The diffuser 250 preferably comprises a plurality of concentric ring prismatic facets 280. In preferred embodiments, the concentric facets 280 comprise V-shaped prisms, but alternatively can take any of a variety of shapes including but not limited to U-shaped or channel-shaped ribs and/or grooves. The included angle of the concentric facets 280 may vary depending on factors including the number of facets and the thickness of the diffuser material, but preferably is between about 120° to 150°, and more preferably about 135°. The angle of inclination 296 of the cone, as well as the angular geometry of the concentric facets 280 have been found to contribute to the superior light distribution and reflective properties of the lumenaire of the present invention.

The specified characteristics of the lumenaire of the present invention and its various individual components have been found to provide significantly improved lighting characteristics in connection with lumen packages comprising a spaced array of multiple high-efficiency lamps, such as compact fluorescent lamps, both individually and in combination. For example, lighting distribution curves and photometric data for illumination tests of various embodiments of the present invention, as generated by the PHOTOPIA optical design and analysis system of Lighting Technologies, Inc. of Denver, Colo. have demonstrated such improved lighting characteristics. Example lighting distribution curves and photometric data was previously disclosed in U.S. Provisional Patent Application Ser. No. 60/803,567 filed May 31, 2006 and has been incorporated herein by reference in its entirety.

While the invention has been described with reference to preferred and example embodiments, it will be understood by those skilled in the art that a variety of modifications, additions and deletions are within the scope of the invention, as defined by the following claims. For example, the diameter of the upper rim of the diffractor may be varied to accommodate different lumen package configurations. Likewise, the overall diameter of the diffractor may vary, for example including 18", 22", 25" and other diameter embodiments. The lamps of the lumen package may be vertical (i.e., parallel to the central axis), or may be inclined at an angle relative to the central vertical axis.

What is claimed is:

1. A lighting diffractor-diffuser system comprising:

a lighting diffractor comprising a light-transmissive shell having an inner surface and an outer surface, the shell having a cross-sectional profile comprising a first parabolic segment positioned toward a top portion of the diffractor, a second parabolic segment positioned at an intermediate portion of the diffractor, and a third parabolic segment positioned toward a lower rim portion of the diffractor; and a diffuser comprising a fresnel lens portion and an angled flange surrounding the fresnel lens portion, the angled flange of the diffuser being attached to the lower rim portion of the diffractor;

wherein the angled flange comprises a plurality of longitudinal facets, each of said longitudinal facets having an included angle of between 70°-90°.

2. The lighting diffractor-diffuser system of claim 1, wherein the angled flange is oriented at an angle of between 100° and 160° relative to the fresnel lens portion.

3. The lighting diffractor-diffuser system of claim 1, wherein the angled flange is oriented at an angle of between 119° and 149° relative to the fresnel lens portion.

4. The lighting diffractor-diffuser system of claim 1, wherein the angled flange is oriented at an angle of about 134° relative to the fresnel lens portion.

5. The lighting diffractor-diffuser system of claim 1, wherein the fresnel lens portion comprises a plurality of concentric circular prismatic facets, each of said concentric circular prismatic facets having an included angle of between 90°-150°.

6. The lighting diffractor-diffuser system of claim 1, wherein the fresnel lens portion comprises a plurality of concentric circular prismatic facets, each of said concentric circular prismatic facets having an included angle of about 127°.

7. A light fixture comprising the lighting diffractor-diffuser system of claim 1 in combination with a multi-lamp lumen package comprising a plurality of high-efficiency lamps.

8. The light fixture of claim 7, wherein the plurality of high-efficiency lamps are oriented generally parallel to a central axis of the shell.

9. The light fixture of claim 7, wherein the plurality of high-efficiency lamps comprise compact fluorescent lamps.

10. The lighting diffractor-diffuser system of claim 1, wherein the outer surface of the shell comprises a plurality of continuously tapered facets, each of said continuously tapered facets tapering progressively wider from the top portion of the diffractor to the lower rim portion of the diffractor.

11. The lighting diffractor-diffuser system of claim 10, wherein the outer surface of the shell comprises between 130-230 continuously tapered facets evenly spaced about a circumference thereof.

12. The lighting diffractor-diffuser system of claim 10, wherein the outer surface of the shell comprises about 180 continuously tapered facets evenly spaced about a circumference thereof, with each facet spanning about two degrees of said circumference.

13. A lighting diffractor-diffuser system comprising:

a lighting diffractor comprising a light-transmissive shell having an inner surface and an outer surface, the shell having a cross-sectional profile comprising a first parabolic segment positioned toward a top portion of the diffractor, a second parabolic segment positioned at an intermediate portion of the diffractor, and a third parabolic segment positioned toward a lower rim portion of the diffractor; and a diffuser comprising a fresnel lens portion and an angled flange surrounding the fresnel lens portion, the angled flange of the diffuser being attached to the lower rim portion of the diffractor;

wherein the angled flange comprises a plurality of longitudinal facets, each of said longitudinal facets having an included angle of about 81°.

14. The lighting diffractor-diffuser system of claim 13, wherein the angled flange is oriented at an angle of between 100° and 160° relative to the fresnel lens portion.

15. The lighting diffractor-diffuser system of claim 13, wherein the angled flange is oriented at an angle of between 119° and 149° relative to the fresnel lens portion.

16. The lighting diffractor-diffuser system of claim 13, wherein the angled flange is oriented at an angle of about 134° relative to the fresnel lens portion.

17. The lighting diffractor-diffuser system of claim 13, wherein the fresnel lens portion comprises a plurality of concentric circular prismatic facets, each of said concentric circular prismatic facets having an included angle of between 90°-150°.

18. The lighting diffractor-diffuser system of claim 13, wherein the fresnel lens portion comprises a plurality of concentric circular prismatic facets, each of said concentric circular prismatic facets having an included angle of about 127°.

19. A light fixture comprising the lighting diffractor-diffuser system of claim 13 in combination with a multi-lamp lumen package comprising a plurality of high-efficiency lamps.

20. The light fixture of claim 19, wherein the plurality of high-efficiency lamps are oriented generally parallel to a central axis of the shell.

21. The light fixture of claim 19, wherein the plurality of high-efficiency lamps comprise compact fluorescent lamps.

22. The lighting diffractor-diffuser system of claim 13, wherein the outer surface of the shell comprises a plurality of continuously tapered facets, each of said continuously tapered facets tapering progressively wider from the top portion of the diffractor to the lower rim portion of the diffractor.

23. The lighting diffractor-diffuser system of claim 22, wherein the outer surface of the shell comprises between 130-230 continuously tapered facets evenly spaced about a circumference thereof.

24. The lighting diffractor-diffuser system of claim 22, wherein the outer surface of the shell comprises about 180 continuously tapered facets evenly spaced about a circumference thereof, with each facet spanning about two degrees of said circumference.

25. A lighting diffractor-diffuser system comprising:

a lighting diffractor comprising a light-transmissive shell having an inner surface and an outer surface, the shell having a cross-sectional profile comprising a first parabolic segment positioned toward a top portion of the diffractor, a second parabolic segment positioned at an intermediate portion of the diffractor, and a third parabolic segment positioned toward a lower rim portion of the diffractor; and a diffuser comprising a fresnel lens portion and an angled flange surrounding the fresnel lens portion, the angled flange of the diffuser being attached to the lower rim portion of the diffractor;

wherein the outer surface of the shell comprises a number of facets, and wherein the outer surface of the angled flange comprises an equal number of facets.

26. The lighting diffractor-diffuser system of claim 25, wherein the facets on the outer surface of the shell have an included angle at the lower rim portion of the diffractor, and wherein the facets on the outer surface of the angled flange have a substantially equal included angle.

27. The lighting diffractor-diffuser system of claim 25, wherein the angled flange is oriented at an angle of between 100° and 160° relative to the fresnel lens portion.

28. The lighting diffractor-diffuser system of claim 25, wherein the angled flange is oriented at an angle of between 119° and 149° relative to the fresnel lens portion.

29. The lighting diffractor-diffuser system of claim 25, wherein the angled flange is oriented at an angle of about 134° relative to the fresnel lens portion.

30. The lighting diffractor-diffuser system of claim 25, wherein the fresnel lens portion comprises a plurality of concentric circular prismatic facets, each of said concentric circular prismatic facets having an included angle of between 90°-150°.

31. The lighting diffractor-diffuser system of claim 25, wherein the fresnel lens portion comprises a plurality of concentric circular prismatic facets, each of said concentric circular prismatic facets having an included angle of about 127°.

32. A light fixture comprising the lighting diffractor-diffuser system of claim 25 in combination with a multi-lamp lumen package comprising a plurality of high-efficiency lamps.

33. The light fixture of claim 32, wherein the plurality of high-efficiency lamps are oriented generally parallel to a central axis of the shell.

34. The light fixture of claim 32, wherein the plurality of high-efficiency lamps comprise compact fluorescent lamps.

35. The lighting diffractor-diffuser system of claim 25, wherein the outer surface of the shell comprises a plurality of continuously tapered facets, each of said continuously tapered facets tapering progressively wider from the top portion of the diffractor to the lower rim portion of the diffractor.

36. The lighting diffractor-diffuser system of claim 35, wherein the outer surface of the shell comprises between 130-230 continuously tapered facets evenly spaced about a circumference thereof.

37. The lighting diffractor-diffuser system of claim 35, wherein the outer surface of the shell comprises about 180 continuously tapered facets evenly spaced about a circumference thereof, with each facet spanning about two degrees of said circumference.

38. A lighting diffractor-diffuser system comprising:

a lighting diffractor comprising a light-transmissive shell having an inner surface and an outer surface, the shell having a cross-sectional profile comprising a first parabolic segment positioned toward a top portion of the diffractor, a second parabolic segment positioned at an intermediate portion of the diffractor, and a third parabolic segment positioned toward a lower rim portion of the diffractor; and a cone-shaped diffuser attached to the lower rim portion of the diffractor;

wherein the cone-shaped diffuser comprises a plurality of concentric ring prismatic facets, each of said plurality of concentric ring prismatic facets having an included angle of between 120° to 150°.

39. The lighting diffractor-diffuser system of claim 38, wherein the cone-shaped diffuser has an angle of inclination of between 3° to 20°.

40. The lighting diffractor-diffuser system of claim 38, wherein the cone-shaped diffuser has an angle of inclination of about 6°.

41. A light fixture comprising the lighting diffractor-diffuser system of claim 38 in combination with a multi-lamp lumen package comprising a plurality of high-efficiency lamps.

42. The light fixture of claim 41, wherein the plurality of high-efficiency lamps are oriented generally parallel to a central axis of the shell.

43. The light fixture of claim 41, wherein the plurality of high-efficiency lamps comprise compact fluorescent lamps.

44. The lighting diffractor-diffuser system of claim 38, wherein the outer surface of the shell comprises a plurality of continuously tapered facets, each of said continuously tapered facets tapering progressively wider from the top portion of the diffractor to the lower rim portion of the diffractor.

45. The lighting diffractor-diffuser system of claim 44, wherein the outer surface of the shell comprises between 130-230 continuously tapered facets evenly spaced about a circumference thereof.

46. The lighting diffractor-diffuser system of claim 44, wherein the outer surface of the shell comprises about 180 continuously tapered facets evenly spaced about a circumference thereof, with each facet spanning about two degrees of said circumference.

47. A lighting diffractor-diffuser system comprising:

a lighting diffractor comprising a light-transmissive shell having an inner surface and an outer surface, the shell having a cross-sectional profile comprising a first parabolic segment positioned toward a top portion of the diffractor, a second parabolic segment positioned at an intermediate portion of the diffractor, and a third parabolic segment positioned toward a lower rim portion of the diffractor; and a cone-shaped diffuser attached to the lower rim portion of the diffractor;

wherein the cone-shaped diffuser comprises a plurality of concentric ring prismatic facets, each of said plurality of concentric ring prismatic facets having an included angle of about 135°.

48. A light fixture comprising the lighting diffractor-diffuser system of claim 47 in combination with a multi-lamp lumen package comprising a plurality of high-efficiency lamps.

49. The light fixture of claim 48, wherein the plurality of high-efficiency lamps are oriented generally parallel to a central axis of the shell.

50. The light fixture of claim 48, wherein the plurality of high-efficiency lamps comprise compact fluorescent lamps.

51. The lighting diffractor-diffuser system of claim 47, wherein the outer surface of the shell comprises a plurality of continuously tapered facets, each of said continuously tapered facets tapering progressively wider from the top portion of the diffractor to the lower rim portion of the diffractor.

52. The lighting diffractor-diffuser system of claim 51, wherein the outer surface of the shell comprises between 130-230 continuously tapered facets evenly spaced about a circumference thereof.

53. The lighting diffractor-diffuser system of claim 51, wherein the outer surface of the shell comprises about 180 continuously tapered facets evenly spaced about a circumference thereof, with each facet spanning about two degrees of said circumference.

* * * * *